US009873987B2

(12) United States Patent
Perrin et al.

(10) Patent No.: US 9,873,987 B2
(45) Date of Patent: Jan. 23, 2018

(54) DECORATIVE PAPER FOR LAYERED PRODUCTS

(71) Applicant: MUNKSJÖ ARCHES, Arches (FR)

(72) Inventors: Claude Perrin, Saint Hilarie de la Cote (FR); Helene Villaume, Rives (FR)

(73) Assignee: MUNKSJO ARCHES, Arches (FR)

( * ) Notice: Subject to any disclaimer, the term of this patent is extended or adjusted under 35 U.S.C. 154(b) by 0 days.

(21) Appl. No.: 14/439,396

(22) PCT Filed: Oct. 30, 2013

(86) PCT No.: PCT/IB2013/059796

§ 371 (c)(1),
(2) Date: Apr. 29, 2015

(87) PCT Pub. No.: WO2014/068502

PCT Pub. Date: May 8, 2014

(65) Prior Publication Data

US 2015/0299962 A1 Oct. 22, 2015

(30) Foreign Application Priority Data

Oct. 30, 2012 (FR) ..... 12 60341

(51) Int. Cl.

| | |
|---|---|
| ***D21H 21/20*** | (2006.01) |
| ***B44C 5/04*** | (2006.01) |
| ***D21H 27/26*** | (2006.01) |
| ***D21H 27/28*** | (2006.01) |
| ***D21H 17/68*** | (2006.01) |

(Continued)

(52) U.S. Cl.

CPC ..... *D21H 21/20* (2013.01); *B41M 5/50* (2013.01); *B44C 5/0469* (2013.01); *D21H 17/675* (2013.01); *D21H 17/68* (2013.01); *D21H 17/74* (2013.01); *D21H 21/00* (2013.01); *D21H 27/26* (2013.01); *D21H 27/28* (2013.01)

(58) Field of Classification Search

CPC ..... D21H 17/675; D21H 17/68; D21H 17/74; D21H 27/26; D21H 27/28

See application file for complete search history.

(56) References Cited

U.S. PATENT DOCUMENTS 1,989,709 A 2/1935 O 'Neil et al.
4,626,290 A * 12/1986 Nakazawa ..... D21H 17/68 106/431

(Continued)

FOREIGN PATENT DOCUMENTS

CN 1128731 A 8/1996
CN 1527898 A 9/2004

(Continued)

OTHER PUBLICATIONS

International Search Report and Written Opinion for corresponding International Application No. PCT/IB2013/059796.

(Continued)

*Primary Examiner* — Betelhem Shewareged
(74) *Attorney, Agent, or Firm* — Jones Robb, PLLC

(57) ABSTRACT

A decorative paper for a high-pressure, low-pressure or continuous-pressed laminate may include, distributed through a thickness of said paper, particles of a filler that have an oil absorption of 80% or higher, and that have a median diameter D50 ranging from 0.5 to 10 μm.

32 Claims, 2 Drawing Sheets

(51) Int. Cl.

| | |
|---|---|
| ***D21H 21/00*** | (2006.01) |
| ***B41M 5/50*** | (2006.01) |
| ***D21H 17/67*** | (2006.01) |
| ***D21H 17/00*** | (2006.01) |

(56) References Cited

U.S. PATENT DOCUMENTS

| | | | | |
|---|---|---|---|---|
| 5,591,256 | A | 1/1997 | Freeman et al. | |
| 5,595,717 | A | 1/1997 | Harper et al. | |
| 5,695,730 | A | 12/1997 | Maejima et al. | |
| 2003/0039810 | A1 | 2/2003 | Schulz et al. | |
| 2004/0197591 | A1 | 10/2004 | Schnieder et al. | |
| 2008/0090032 | A1 | 4/2008 | Perrin et al. | |
| 2009/0131573 | A1* | 5/2009 | Herbiet | C01F 7/021 524/437 |
| 2010/0236737 | A1 | 9/2010 | Johansson-Vestin et al. | |
| 2012/0048145 | A1* | 3/2012 | Wang | C09C 1/3081 106/457 |

FOREIGN PATENT DOCUMENTS

| | | | |
|---|---|---|---|
| CN | 101680191 | A | 3/2010 |
| EP | 1 044 822 | A1 | 10/2000 |
| EP | 1 749 134 | B1 | 8/2009 |
| JP | 61-152896 | A | 7/1986 |
| JP | 62-292476 | A | 12/1987 |
| WO | 94/18121 | A1 | 8/1994 |
| WO | 02/081228 | A1 | 10/2002 |

OTHER PUBLICATIONS

French Search Report and Written Opinion, with partial English translation from Google Translate, for corresponding French Application No. 12 60341 dated Aug. 12, 2013.

Chinese Office Action for corresponding application No. CN 201380069003.4 dated Feb. 3, 2016, with machine-generated English translation.

Japanese Office Action, dated Aug. 27, 2017, in related Japanese Application No. 2015-540252, with English translation.

* cited by examiner

DECORATIVE PAPER FOR LAYERED PRODUCTS

This application is a national stage application of International PCT Application No. PCT/IB2013/059796, filed internationally on Oct. 30, 2013, which claims priority to French Application No. FR 12 60341, filed Oct. 30, 2012, the entire contents of each of which is incorporated by reference herein in its entirety.

The present invention relates to the field of decorative papers.

In particular, the invention relates to a decorative paper, also called decoration paper or decorative sheet, suitable for inkjet printing, to a process for manufacturing such a paper, and to a laminate comprising such a paper.

For many years, laminated decorative boards or profile products (also called "laminates") have been used as materials in houses and commercial and industrial premises. Typical applications of such laminates are floor coverings, in particular those imitating parquet flooring, furniture coverings, tabletops or chairs, inter alia.

There are two major types of decorative "laminates": those termed high-pressure laminates (HPLs) and those termed low-pressure laminates (LPLs).

High-pressure decorative laminates are produced from a body consisting of sheets impregnated with resin. These sheets are generally made of kraft paper and have been impregnated with a thermosetting resin, most commonly a phenolic resin.

After the sheets have been impregnated with resin, they are dried, cut up then stacked on each other. The number of sheets in the stack depends on the applications and typically varies between 3 and 9, but may be greater. A decorative paper is then placed on the stack of sheets constituting the body, said decorative paper generally being a sheet of paper bearing a printed or colored pattern or comprising decorative particles, impregnated with a thermosetting resin, chosen from melamine-formaldehyde resins, urea-formaldehyde resins or benzoguanamine-formaldehyde resins, or unsaturated polyester paper.

Generally, a protective sheet, termed "overlay", that has no patterns and is transparent in the final laminate, is placed on top of the decorative paper, in order to improve the abrasion resistance of the laminate. The stack of impregnated sheets is then placed in a laminating press of which the platens are provided with a steel sheet conferring the desired surface finish on the laminate. The stack is then densified by heating, to a temperature of about 110° C. to 170° C., and by pressing, at a pressure of about 5.5 MPa to 11 MPa, for approximately 25 to 60 minutes, so as to obtain a unitary structure.

This structure is then fixed to a base support; for example, it is adhesively bonded to a board of agglomerated particles, in particular agglomerated wood particles.

It is possible to obtain high-pressure laminates according to a process "without impregnation" or "dry process", which consists in using a decoration paper not impregnated with thermosetting resin, generally sandwiched between a barrier paper impregnated with resin placed on the bottom, and an overlay protective sheet also impregnated with resin and placed on the top. Variants exist where the overlay sheet is not placed on the top, but on the bottom. The impregnation of the decorative paper with the resin takes place when a pressure is exerted on the stack of the various sheets, by diffusion of the resin out of the sheets of the barrier and overlay papers with which the decorative paper is in contact or to which the latter is in proximity.

In addition to the high-pressure and low-pressure processes, there is a continuous laminating process called CPL (continuous pressed laminate) process, which is similar to the high-pressure process, but in which impregnated papers unwound from spools are used instead of precut sheets.

The "low-pressure" decorative laminates are produced using only one decorative sheet impregnated with thermosetting resin, and eventually an overlay sheet, which is laminated directly on the base support during a short cycle, the temperature being about from 160 to 175° C. and the pressure from 1.25 MPa to 3 MPa.

The decorative paper used for the manufacture of laminates is generally a sheet of paper made on a paper machine. A decorative paper is generally used to confer a particular esthetic appearance on a laminate support to which it is affixed, it being possible for this appearance to result from the printing of a decorative pattern on the paper.

As it happens, this decorative pattern which conventionally consisted in imitating the appearance of a natural material, such as wood or marble, has taken on more diversified forms given the demand, so as to adapt to the needs and wishes of clients. This increase in the variety of the patterns has been accompanied, conversely, by a reduction in the amounts to be produced.

This phenomenon of the customization of decoration and of short production runs has not been without consequences on the difficulties encountered by decorative paper manufacturers. Indeed, for mass production of simple patterns, printing techniques such as photogravure had the advantage of printing wide at high production rates. As it happens, these printing techniques do not prove to be profitable for short production runs; furthermore, the printing reproduction obtained is not satisfactory for complex patterns which require high resolution.

Among the printing techniques that are sufficiently flexible for the production of small amounts on demand, inkjet printing has proved to be the technique most suited to the needs of decorative papers. In addition to the simplicity of its implementation and the relatively low associated cost, inkjet printing also makes it possible to obtain better quality printing, and in particular very good image definition and a strong color density with low ink consumption.

However, the use of the inkjet printing technique in the manufacture of decoration papers remains confronted with a major difficulty associated with the process for obtaining the laminates themselves.

In the conventional process for manufacturing laminates, the decorative paper is first printed, and then impregnated with resin and finally hot-pressed with its support at high or low pressure. The impregnation step requires the availability of a decorative paper having high wet resistance, so as to preserve sufficient strength after it is totally immersed in the resin, said resin preferably being aqueous, and also the greatest possible capacity to absorb resin in the shortest possible time. These characteristics are generally obtained by using decorative papers having a very high porosity.

The inkjet printing technique is today based on the principle of fixing ink to the surface of the substrate to be printed; the latter must therefore have a controlled ink absorption in order to obtain clear, high-quality printing. Thus, the papers normally used for inkjet printing outside the field of the manufacture of laminates for producing color printing, graphics or printing of photographic quality have a closed surface, produced by a coating of synthetic resin or a layered coating. Such papers may not therefore be suitable for the preparation of laminates, given that they cannot be satisfactorily impregnated with a thermosetting resin. Likewise, these papers which are not part of the category of decoration papers, cannot be suitable for the lamination process without impregnation (dry process), because of the delamination of the various layers which occurs during steam-resistance and water-immersion tests.

It also appears that the decorative papers used in the past may not be suitable as they are for inkjet printing because of their high porosity, required for rapid and uniform impregnation by the resin.

Decorative papers improved by coating with a layer comprising ink-fixing particles have already been described, in particular in patents EP 1 749 134 and EP 1 044 822.

Patent EP 1 044 822 describes the use of conventional coating techniques which may result in substantially reducing the resin-impregnation properties of the paper because of the penetration of the layer into the paper.

Patent EP 1 749 134 claims a coating process for obtaining an inkjet-printable decoration paper without substantial reduction of its impregnation properties. However, such a paper is not entirely satisfactorily suitable for producing a high-pressure laminate by means of the dry lamination process because of the delamination which occurs during steam-resistance and water-immersion tests carried out on the high-pressure laminates.

Figure 1:
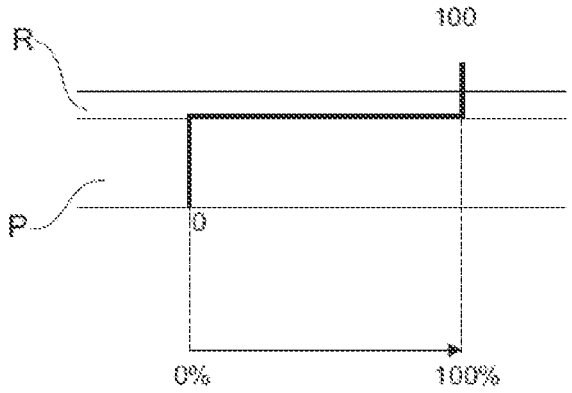
PRIOR ART Fig. 1
FIG. 1 is a graph of a conventional profile of an average relative distribution of silica particles through a thickness of a paper.

International application WO 02/081228 describes a sheet of decorative paper for high-pressure or low-pressure laminates, comprising silica particles throughout its thickness, with the aim of improving the abrasion-resistance of the paper. In this perspective, the silica particles used have a relatively large diameter, which is too coarse to improve the printability properties of the paper.

As the prior art reveals, the manufacture of a decorative paper which allows good-quality inkjet printing while having a high resin absorption capacity for manufacturing high-pressure or low-pressure laminates presumes being able to satisfy contradictory requirements.

Likewise, the manufacture of a decorative paper which allows good-quality inkjet printing while being suitable for the preparation of laminates by means of a dry lamination process ("dry process") raises considerable difficulties.

The invention aims to overcome the problems encountered in the prior art by decorative papers for laminates by providing a decorative paper which both has good printability in inkjet printing and is suitable for industrially producing all types of laminates, with or without prior impregnation of the decorative paper, in particular by implementing high-pressure, low-pressure or dry processes.

Thus, a subject of the invention is a decorative paper for a high-pressure (HPL), low-pressure (LPL) or continuous pressed (CPL) decorative laminate, comprising, distributed through the thickness of said paper, particles of a filler having a relatively high oil absorption, preferably greater than or equal to 80%. These filler particles may also be called, by misuse of language, "pigment" particles, even though they do not necessarily give the paper color.

Unexpectedly, the applicant has observed that it is possible to obtain decorative papers which have good printability by inkjet printing and which can be impregnated with a thermosetting resin for the production of conventional high-pressure or low-pressure laminates, or continuous pressed laminates, or which can be used in a dry process, by incorporating into the decorative paper a particulate filler chosen for its oil absorption properties.

As demonstrated by the results of tests carried out with the decoration paper examples described in detail hereinafter, the decorative papers according to the invention have good printability by inkjet printing whatever the nature of the ink, be it aqueous, UV-crosslinkable, or in solution in an organic solvent or an eco-solvent. What is more, this good printability is obtained without the need to pre-deposit an ink-fixing layer on the paper, thereby making it possible to simplify the manufacturing of the decorative paper. Furthermore, the decorative paper according to the invention becomes compatible with printing on both or either of its faces, which is not the case with a decorative paper according to the prior art, coated on one face. Finally, such a paper may be absolutely suitable for the preparation of a laminate without impregnation.

A subject of the invention is also a decorative paper comprising, before impregnation thereof with a thermosetting resin, at least one pattern printed on at least one of its faces. Such a pattern may be printed by inkjet printing, preferably with an aqueous ink, a UV-crosslinkable ink, a solvent ink or an eco-solvent ink.

According to yet another of the subjects thereof, the invention relates to a process for preparing a decorative paper, comprising the steps consisting in:

preparing a wet fibrous cellulose composition, and introducing into the fibrous composition, in the wet part of a paper machine, particles of a filler according to the invention.

According to yet another of the subjects thereof, the invention relates to a high-pressure, low-pressure or continuous-pressed laminate, comprising at least one decorative paper according to the invention.

According to yet another of the subjects thereof, the invention relates to the use of particles of a filler according to the invention in a decorative paper for a high-pressure, low-pressure or continuous-pressed decorative laminate, for improving the printability by inkjet printing of said decorative paper.

Filler

For the purposes of the invention, the term "filler particles" or "filler" is intended to denote particles of a single type of particulate material or a mixture of particles of various types of particulate materials. Preferably, the filler consists of a single particulate material.

The particles of a filler suitable for the invention have an oil absorption greater than or equal to 80%, better still greater than or equal to 100%, preferably greater than or equal to 150%, preferably greater than or equal to 200%, and more preferentially greater than or equal to 300%.

The particles of the filler of the invention may have an oil absorption at most equal to 400%, or even at most equal to 360%.

The oil absorption property of the filler according to the invention is measured according to standard DIN ISO 787 part 5.

The particles of the filler suitable for the invention preferably have a specific surface area greater than or equal to 10 $m^2/g$, preferably greater than or equal to 20 $m^2/g$, preferably greater than or equal to 50 $m^2/g$, preferably greater than or equal to 80 $m^2/g$, preferably greater than or equal to 100 $m^2/g$, more preferably greater than or equal to 200 $m^2/g$, and even more preferentially greater than or equal to 300 $m^2/g$.

The particles of the filler according to the invention may have a specific surface area at most equal to 1000 $m^2/g$, preferably at most equal to 800 $m^2/g$.

The specific surface area of the particles of a filler suitable for the invention is measured using the BET method according to standard DIN 66132.

The particles of a filler suitable for the invention may have a diameter ranging from 0.5 to 10 μm, preferably ranging from 2 to 8 μm, and more preferentially ranging from 3 to 5 μm. The term "diameter" denotes the diameter of the circle circumscribed.

The particles of a filler suitable for the invention preferably have a median diameter D50 ranging from 0.5 to 10 μm, preferably from 2 to 8 μm, and more preferably ranging from 3 to 5 μm.

Likewise, particles of fillers suitable for the invention may have a median diameter D50 ranging from 1 to 3 μm.

The particles of a filler suitable for the invention may have a shape chosen from a lamellar shape, a globular shape, a spherical shape, or any other intermediate shape between the shapes previously defined. Preferably, the shape of the particles is approximately spherical.

Preferably, the particles of a filler suitable for the invention have a refractive index n of less than 1.9, and preferably ranging from 1.2 to 1.8, and more preferably ranging from 1.4 to 1.7, and even more preferentially ranging from 1.5 to 1.6. More preferably, the particles of a filler suitable for the invention have a refractive index n of approximately 1.55.

The refractive index is measured using a refractometer, the most well known of which is the one from Abbe.

Advantageously, the particles of a filler of the invention will be chosen so as to have a refractive index equal to, or substantially similar to, the refractive index of the thermosetting resin intended to impregnate the decorative paper of the invention.

Thus, between a filler of the invention and a thermosetting resin, the difference $\Delta_n$ between the refractive indices may advantageously be less than or equal to 0.5, even better still less than or equal to 0.3, more preferably less than or equal to 0.2, or even less than or equal to 0.1.

The identity, or the proximity, of the values of the refractive index of the filler and of the refractive index of the thermosetting resin may make it possible to confer increased transparency on the decorative paper after impregnation thereof with the resin.

The particles of a filler according to the invention may be chosen from inorganic particles, organic particles, and mixtures thereof. Preferably, the particles of the filler are chosen from inorganic particles, or mixtures thereof.

Quite particularly preferably, the inorganic particles of a filler according to the invention have a specific surface area greater than or equal to 50 $m^2/g$ and an oil absorption greater than or equal to 80%, preferably a specific surface area greater than or equal to 100 $m^2/g$ and an oil absorption greater than or equal to 80%, more preferably a specific surface area greater than or equal to 200 $m^2/g$ and an oil absorption greater than or equal to 80%, preferably a specific surface area greater than or equal to 200 $m^2/g$ and an oil absorption greater than or equal to 150%, and even more preferentially a specific surface area greater than or equal to 300 $m^2/g$ and an oil absorption greater than or equal to 200%.

The inorganic particles of a filler according to pigment of the invention may be chosen from particles of amorphous silicas, particles of precipitated silicas, particles of diatomaceous earths, particles of aluminosilicates, and mixtures thereof. Preferably, such particles are chosen from particles of amorphous silicas, particles of precipitated silicas, particles of aluminosilicates, and mixtures thereof. More preferably, such particles are chosen from particles of amorphous silicas, particles of precipitated silicas, and mixtures thereof, and even more preferentially they are chosen from particles of amorphous silicas, and mixtures thereof.

Particles of inorganic filler suitable for the invention may be chosen from particles of amorphous or precipitated silicas of Syloid® type, sold by the company Grace, particles of diatomaceous earths of Celite® type, sold by the company World Minerals, or particles of aluminosilicates of Zeolex® type, sold by the company Huber Engineered Materials.

Advantageously, the particles of a filler according to the invention are present in an amount ranging from 3% to 40% by weight relative to the total dry weight of the paper, preferably ranging from 5% to 35%, more preferably from 8% to 30%, preferably ranging from 10% to 30%, more preferably ranging from 10% to 25%, even more preferentially ranging from 15% to 25%, and more preferentially ranging from 15% to 20% by weight relative to the total dry weight of the paper.

The weight of filler, for an inorganic filler, of a paper of the invention is determined by measuring the amount of ash of the paper according to standard ISO 2144:1997, corrected by the ignition loss of the filler used which must be known.

A decorative paper according to the invention may comprise a single type of particle of a filler suitable for the invention, or a mixture of various types of filler particles, for example at least two, or even at least three, or else at least four types of filler particles. The expression "various types of filler particles" is intended to mean particles of fillers which differ from one another by virtue of their oil absorption and/or specific surface area characteristic.

It is understood that, when a decorative paper according to the invention comprises more than one type of particle of a filler according to the invention, in particular at least two, or even at least three, or else at least four distinct types of particles according to the invention, i.e. which comply in terms of oil absorption, the amounts indicated above should be understood as referring to the mixture of these particles, and not to each type of particle taken individually.

According to one preferred embodiment, with a view to inkjet printing with an aqueous ink, a decorative paper of the invention advantageously comprises inorganic particles of filler which are chosen from particles of amorphous silicas, particles of precipitated silicas, particles of aluminosilicates, and mixtures thereof. More preferably, in such an embodiment, particles of amorphous silicas, particles of precipitated silicas, or mixtures thereof, are used.

Advantageously, these particles are used in a content ranging from 15% to 25%, and more preferably in a content of approximately 20% by weight relative to the total dry weight of the paper.

According to another preferred embodiment, with a view to inkjet printing with a UV-crosslinkable ink, a decorative paper of the invention advantageously comprises inorganic particles of filler which are chosen from particles of amorphous silicas, particles of precipitated silicas, and mixtures thereof.

Advantageously, these particles are used in a content ranging from 15% to 25% by weight relative to the total dry weight of the paper.

The filler particle contents above are given for a dry paper, before printing and before impregnation thereof with a thermosetting resin.

The fillers, in particular the inorganic fillers, used in the invention preferably exhibit neutrality in terms of acidity or alkalinity with respect to the thermosetting resins. The expression "neutrality in terms of acidity or alkalinity of the fillers according to the invention with respect to the thermosetting resins" is intended to denote the fact that the fillers behave neither as acids nor as bases with respect to the thermosetting resins.

Decorative Paper

A decorative paper according to the invention may have a grammage ranging from 20 to 100 g/m$^2$ and preferably from 40 to 80 g/m$^2$.

The grammage of the sheets is determined according to standard ISO 536 after conditioning according to standard ISO 187. It is the grammage of the sheet before impregnation with a thermosetting resin.

A decorative paper according to the invention comprises, distributed through the thickness of the paper, particles of a filler, as previously defined.

Unlike a coated decorative paper according to the prior art, a paper according to the invention comprises particles of filler according to the invention in its core. On the other hand, a coated decorative paper according to the prior art comprises particles of fillers only in the layer deposited at the surface.

The profile of the distribution of the particles through the thickness of the paper may depend on the way in which the particles are introduced into the paper.

The profile of the distribution of the particles of filler in a paper of the invention shows that said particles are present in the paper substrate.

The profile of the distribution of the filler in the decorative papers of the invention may involve a maximum approximately between ¼ and ¾ of the total thickness e of the paper.

The distribution of the particles of filler through the thickness of the paper may exhibit a distribution profile increasing between one face of the paper toward half the thickness of said paper.

The profile of the distribution of the particles of filler may exhibit a maximum between one face and half the thickness of the paper.

The distribution of the particles of filler may be anisotropic within the paper.

The distribution profile is nonsymmetrical relative to a median plane which cuts the paper at the mid-thickness.

The profile of the distribution of the particles of filler through the thickness of a paper of the invention exhibits a minimum on the side of the face of the paper in contact with the forming wire or surface, and a maximum on the side of the opposite face.

The determination of an average profile of distribution of the particles of fillers in a paper may be carried out by analysis of electron microscopy images taken in backscattered electron detection mode or of elementary maps acquired by X-ray microanalysis in an SEM (scanning electron microscope). Paper sections are prepared in such a way that several centimeters of sample can be observed. Several tens of images are acquired along these sections, about thirty generally being sufficient, and are then processed by image analysis. The edges of the paper are first of all identified so as to extract the paper zone. The latter is then automatically divided into about twenty layers of equal thickness in any abscissa along the extracted paper zone: slices each corresponding to a given depth within the paper are thus obtained. The inorganic fillers present in the paper zone are then extracted in turn and allocated to the depth slice in which they are located. It is then sufficient to count the proportion of fillers in each slice to obtain a relative distribution of the inorganic fillers from one face to the other of the paper. The relative distributions obtained for each image are averaged and finally produce the curve of average relative distribution of the inorganic fillers for the paper analyzed.

By way of example, represented in FIG. 1 is the profile of the average relative distribution of the silica particles of example 4 of patent EP 1 749 134 through the thickness of the paper. It is seen that the silica particles remain confined at the surface, in the coating layer R, and are absent from the paper substrate P.

Figure 2A:
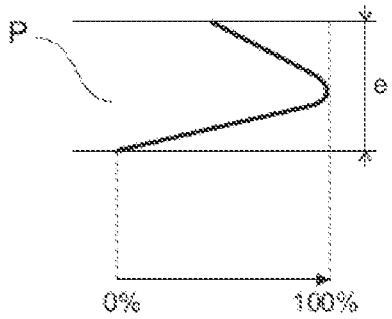
FIG. 2A is a graph of a profile of an average relative distribution of silica particles through a thickness of a decorative paper according to an embodiment.
Figure 2B:
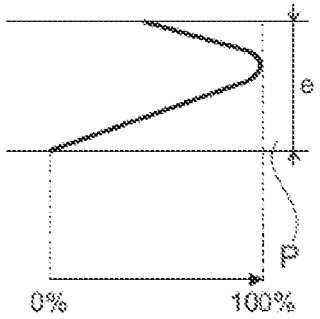
FIG. 2B is a graph of another profile of an average relative distribution of silica particles through a thickness of a decorative paper according to an embodiment.

FIGS. 2A and 2B represent, respectively, two examples of profiles of average relative distribution of the particles of filler through the thickness of decorative papers according to the invention, obtained by bulk introduction (FIG. 2A), i.e. mixing the particles of filler with the fibrous cellulose composition before deposition on the forming surface, or by spraying a solution containing the filler onto the fibrous cellulose composition on a forming table in the wet phase of a paper machine (FIG. 2B).

In a paper of the invention obtained by mixing the filler with a fibrous cellulose composition before deposition on a forming surface (FIG. 2A), the maximum of the filler distribution profile lies substantially at mid-thickness of the paper.

In a paper of the invention obtained by spraying the filler onto a fibrous cellulose composition before deposition on a forming surface (FIG. 2B), the maximum of the filler distribution profile lies substantially in the quarter of the thickness from the face having received the particles of filler.

A decorative paper according to the invention has, in particular, the characteristic of being printed, in particular by inkjet printing, while retaining thermosetting resin absorption properties identical or similar to those of known decorative papers.

Owing to the distribution of the filler through its thickness, a paper of the invention has the advantage of being able to be printed indifferently on either of its faces, or even on both its faces, which may make it possible to create optical depth effects owing to the transparency of the paper on the laminate.

The impregnation of a decorative paper according to the invention with a thermosetting resin is advantageously carried out after a step of inkjet printing of this paper.

A decorative paper according to the invention may exhibit a speed of impregnation with a thermosetting resin, as defined hereinafter, of less than or equal to 20 seconds, preferably less than or equal to 10 seconds, preferably ranging from 2 to 20 seconds, more preferably ranging from 3 to 10 seconds, and more preferably ranging from 3 to 6 seconds, in particular on each of its faces.

The impregnation speed is characterized by the determination of the time taken by the thermosetting resin to penetrate through the sheet; this time is determined in the following way:

- a solution of resin at 56% by weight is prepared by dissolving powdered Kauramin 773 melamine-formaldehyde resin in distilled water heated to 45° C. Its viscosity is adjusted such that it is about 100 mPas (cps) at around 20° C. on a Brookfield viscometer measured at 100 revolutions/min—spindle No. 2,
- the impregnation time of a sheet of paper is determined as follows:
- two square (10×10 cm) samples are cut out per test; in order to test each face, the face is marked,
- a watch glass is filled with resin,
- the square of paper is deposited on the surface of the resin, the face to be tested in contact with said resin, and the timer is started at the same time,
- the time taken for the resin to go totally through, which gives the resin penetration time, is noted.

A decorative paper according to the invention may have a Gurley porosity of 5 to 50 seconds, ideally 10 to 20 seconds. The air-permeability, or Gurley porosity method, is determined according to standard ISO 5636-5R (1990).

A decorative paper of the invention may be smoothed or non-smoothed. A decorative paper according to the invention may be smoothed by any process known to those skilled in the art.

According to one embodiment, a decorative paper of the invention has, on at least one of its faces, a Bekk smoothness of 20 to 140 seconds.

A decorative paper according to the invention may be devoid of filler particles other than those previously defined. In other words, the decorative paper of the invention may comprise only, as particulate filler, filler particles in accordance with the invention, i.e. a decorative paper according to the invention may be devoid of inorganic or organic fillers other than those having an oil absorption greater than or equal to 80%. In particular, a paper according to the invention may be devoid of $TiO_2$ particles.

Alternatively, a decorative paper of the invention may comprise, in its matrix, a filler other than according to the invention, such as kaolin particles. Such an embodiment makes it possible to reduce the amount of cellulose in the paper and may result in a reduction in paper production costs. The amount of such a replacement filler may range from 0 to 35% by weight relative to the dry weight of the paper.

The decorative paper according to the invention does not require the deposition of an ink-fixing layer by coating, as in the prior art, said fixing layer comprising a binder.

Thus, a decorative paper of the invention is advantageously devoid of ink-fixing surface layer, and associated compounds, typically an acrylic binder, polyvinyl alcohol, poly(vinyl acetate) and titanium dioxide.

The opacity of a decorative paper according to the invention is preferably relatively low.

A decorative paper of the invention may advantageously be, before or after impregnation with a thermosetting resin, and preferably after impregnation, transparent.

The opacity of the papers is measured according to standard ISO 2471. The luminance of the paper sample ($L_0$) is measured on a black background, the luminance to infinity ($L_\infty$) is measured on a stack of the same paper. The opacity is calculated according to the formula: $L_0/L_\infty \times 100$.

The lower the value obtained, the less opaque the paper is, and, consequently, the more transparent it is.

A decorative paper according to the invention may have, before impregnation with the thermosetting resin and before inkjet printing, an opacity $L_0/L_\infty \times 100$ greater than 60%, in particular ranging from 60% to 90%, or even from 70% to 90%.

A high-pressure or low-pressure laminate obtained with a decorative paper according to the invention may comprise one or more layers having a certain transparency.

The measurement of the opacity on the high-pressure (HP) or low-pressure (LP) laminates is carried out in a manner similar to that performed on the decoration paper. The measurement of the luminance $L_0$ of the laminate is carried out on the kraft side, the measurement of the luminance of the laminate to infinity ($L_\infty$) is carried out on a white background. The opacity is calculated according to the formula: $L_0/L_\infty \times 100$. The lower the value obtained, the less opaque the paper is, or the more transparent it is.

A high-pressure or low-pressure laminate obtained with a decorative paper according to the invention may have an opacity $L_0/L_\infty \times 100$ of less than 20%, in particular ranging from 7% to 15%.

A paper according to the invention may have the advantage of bringing little or no opacity, and may be used with a white or colored bottom sheet on which it is superimposed. This offers additional decorative possibilities, namely makes it possible to use the same decorative paper which has been printed and laminated on various colored backgrounds.

According to one implementation variant, a decorative paper of the invention is used in combination with a colored decorative paper. Such a colored decorative paper is, for example, placed between the decorative paper of the invention (placed on the top) and the body of the laminate under consideration (placed on the bottom).

The term "colored paper" denotes any decorative paper which has a non-white tint other than a white tint. For example, a colored decorative paper is a paper with a red, blue, green or even black tint.

A decorative paper according to the invention may comprise a pattern printed on at least one of its faces. The printing of this pattern is advantageously carried out by means of inkjet printing. The printing of the pattern is carried out after the drying step and prior to its impregnation with the thermosetting resin.

A decorative paper of the invention may comprise, moreover, the usual constituents which are part of the formulation of decorative papers.

Other Constituents

A decorative paper of the invention naturally comprises cellulose fibers.

The cellulose fibers may be a mixture of short cellulose fibers and long cellulose fibers.

Advantageously, a decorative paper of the invention comprises a mixture of cellulose fibers comprising from 40% to 100%, preferably 70% to 90%, or even approximately 80% of short cellulose fibers, and from 0 to 60%, preferably from 10% to 30%, or even approximately 20% of long cellulose fibers, by dry weight.

According to one embodiment, the short cellulose fibers are *eucalyptus* fibers.

According to one embodiment, a decorative paper of the invention is devoid of synthetic fibers.

A decorative paper of the invention may comprise at least one additional agent chosen from the group consisting of a wet strength agent, a retaining agent, decorative particles, fillers, a cationic polymer and an absorbent organic polymer.

A decorative paper of the invention may comprise at least one wet strength agent.

The term "wet strength agent" is intended to mean any agent capable of conferring tensile strength on the paper in the wet state. Such agents are known to those skilled in the art. Preferably such an agent may be a polyamine-epichlorohydrin resin, a polyamide/polyamine-epichlorohydrin resin, a cationic polyacrylate, a modified melamine-formaldehyde resin or a cationic starch.

A wet strength agent may be present in a proportion of from 0.2% to 2.5% by weight relative to the dry weight of the sheet, and more preferentially from 0.4% to 0.8%.

A decorative paper of the invention may comprise in its composition at least one retaining agent.

The term "retaining agent" is intended to mean any agent capable of allowing the attachment of the inorganic fillers to the fibers. Such agents are known to those skilled in the art. Preferably, such an agent may be chosen from the group consisting of an inorganic microparticle system, for example anionic silicas, and a polyacrylamide of low ionicity.

The term "low iconicity" from the viewpoint of a polyacrylamide suitable for the invention is intended to mean a polyacrylamide containing few cationic comonomers of quaternary ammonium type and/or few acrylate groups of anionic nature.

In addition, a decorative paper may comprise the possible agents used to place the fillers of the invention in an aqueous dispersion, as described hereinafter.

A decorative paper of the invention, after drying and before printing, in particular inkjet printing, may be subjected to a surface treatment, for example in order to improve its smoothness or to deposit an agent for improving ink fixing. The term "surface treatment" is intended to mean subjecting a paper of the invention to a process which affects said paper in the superficial part of its thickness. Thus, a surface treatment of a paper according to the invention with a chemical agent results in the penetration of the latter into the thickness of the paper. The term penetrating coating may be used. Such a process is different from surface coating, which results in depositing a layer at the surface of the paper, without said layer being intended to penetrate into the thickness of said paper.

According to one embodiment, a paper of the invention may be surface-treated with at least one agent intended to improve or promote ink fixing. However, as previously specified, a decorative paper of the invention may be devoid of ink-fixing layer. The agents which can be used in a surface treatment of a paper of the invention are not intended to fix inks, but are only intended to promote fixing thereof. The primary ink-fixing effect is obtained by means of the filler according to the invention distributed through the matrix of said paper. An agent intended to be used in a surface treatment of a paper of the invention may be devoid of particles in accordance with the invention, and/or of other inorganic or organic particulate fillers.

A decorative paper of the invention may be surface-treated (penetrating coating) with at least one cationic polymer.

Such polymers are known to those skilled in the art, and may be advantageously used to prevent inks, and in particular aqueous inks, from running in water. Preferably, such a polymer may be chosen from the group consisting of a polyamine, a copolymer of epichlorohydrin and dimethylamine, and a polydialkyldimethylammonium chloride. More preferably, such a polymer may be a polydiallyldimethylammonium chloride.

A decorative paper of the invention may be surface-treated (penetrating coating) with at least one absorbent organic polymer.

Such polymers are known to those skilled in the art, and may be advantageously used to surface-fix the inks. Preferably, such a polymer may be chosen from the group consisting of a polyvinylpyrrolidone, a polyvinyl alcohol, a carboxymethylcellulose, and a microcrystalline cellulose. More preferably, such a polymer may be a microcrystalline cellulose.

As previously described, during the manufacture of the high-pressure, low-pressure or continuous-pressed laminates, the decorative paper is generally first printed, then impregnated with a thermally stable thermosetting resin, and finally hot-pressed with its support at high or low pressure. Alternatively, as previously described, in the case of the dry process, the printed decorative paper is stacked, while non-impregnated, between two papers impregnated with thermosetting resin, and the impregnation of the decorative paper takes place during the pressure exerted on the whole of the stack.

Consequently, a decorative paper of the invention may be used with or without thermosetting resin.

In particular, this thermosetting resin may be chosen from melamine-formaldehyde resins, urea-formaldehyde resins, benzoguanamine-formaldehyde resins, unsaturated polyester resins, dicyandiamide-formaldehyde resins, epoxy resins, polyurethane resins and acrylic resins, and mixtures thereof.

Once impregnated with resin, the decorative paper is heated, and the resin is partially crosslinked (thermoset) so that it is no longer in a tacky state and that the sheet can be handled. A decorative paper impregnated with partially crosslinked resin is called, in the art, "decoration film" or "decorative film" or else "melamine-resin film". This melamine-resin film contains a resin content preferably ranging from 50% to 55%, but which can range from 45% to 65%.

This step is generally carried out by heating the decorative paper at temperatures of approximately 110 to 140° C. and is controlled, so that the resin during the final lamination of the decoration film flows correctly into the sheet, by measuring the content of volatile compounds remaining in the decoration film. Indeed, this decoration film then comprises a certain percentage, of about 5% to 8%, of volatile products (water, being the solvent for the resin, water resulting from the chemical condensation of the resin, residual formaldehyde, other residual products, etc). These volatile compounds represent the compounds which will be removed during the complete crosslinking of the resin, during the lamination of the decoration film.

The resin, once it has been completely crosslinked, will provide, after lamination, the final laminate with surface resistance (abrasion resistance, resistance to soiling, to steam and to chemicals, such as solvents, acids and bases, etc).

According to one particular case, a decorative paper of the invention is impregnated with a thermosetting resin, then the resin is partially crosslinked in acidic medium, the volatile compound content being between 5% and 8% by weight of the sheet.

The invention also relates to a laminated decorative board or profiled product comprising at least one decorative paper of the invention.

A laminate according to the invention may comprise a superimposition, by contact, of at least two, preferably at least three, and more preferentially at least four, decorative papers according to the invention.

The presence of a decorative paper comprising at least one pattern printed on two faces, or the superimposition of a plurality of decorative papers of the invention, each comprising at least one pattern printed on at least one face, may advantageously make it possible to create an optical effect of relief.

In such an embodiment, the sheets of decorative paper of the invention are printed, with at least one pattern, on one or two faces, impregnated with thermosetting resin, and then stacked on top of one another, and placed on a support, as appropriate sheets of kraft paper impregnated with thermosetting resin or a board of agglomerated particles, and optionally covered with an overlay, which is also impregnated with resin, before being pressed.

A sheet of bulk-colored decorative paper, also impregnated with resin, may advantageously be placed between the support and the stack of sheets of decorative paper.

Manufacturing Process

The fibrous base of a decorative paper of the invention, comprising cellulose fibers, may be prepared by any process known to those skilled in the art.

Thus, a wet fibrous cellulose composition, or paper pulp, is first prepared.

The particles of filler of the invention may be introduced into the wet fibrous cellulose composition, where appropriate supplemented with the agents indicated above, during the continuous manufacture of the paper pulp, in the wet part of the paper machine.

For the purposes of the invention, the term "wet part" from the viewpoint of a paper machine is intended to mean any part of the paper machine in the paper manufacturing process positioned before the dryer, and in particular before the section of presses.

The particles of filler may be introduced in the form of a powder or in the form of a dispersion, preferably an aqueous dispersion.

Preferably, the particles are introduced in the form of a dispersion, in particular an aqueous dispersion, which may comprise any agent capable of promoting the stability of this dispersion. For example, the aqueous dispersion comprises, in addition to the particles of filler of the invention, an agent for preventing settling out or flocculation of the particles or a surfactant, or a viscosifying agent. It is possible, for example, to envision the use of carboxymethylcellulose, microcrystalline cellulose, sodium alginate, hydroxypropylcellulose, polyvinyl alcohol, starch, or mixtures thereof. Mention may also be made of polycarboxylates; cellulose-based thickeners, such as methylcellulose, ethylcellulose, hydroxyethylcellulose and hydroxypropylcellulose, natural gums, in particular guar gum, gum arabic, agar gum, pectins; proteins, in particular casein, soya proteins, gelatin.

According to one preferred implementation variant, the aqueous dispersion of particles of filler consists substantially of a mixture of water and said particles of filler. The term "substantially" is intended to indicate that the dispersion is obtained by mixing only water and particles of filler, but that it is not possible to exclude the presence of contaminants or impurities naturally present in the water and/or the particles of filler, but which do not affect the properties of the aqueous dispersion or of the decorative paper of the invention.

When the fillers are introduced in the form of a dispersion into the fibrous composition, the dispersion may contain from 5% to 40% of particles of filler, by weight.

According to one embodiment, the particles of filler are mixed with the fibrous cellulose composition before said composition is deposited on the forming surface.

This mixing can be carried out, for example, in the paper pulp vat, in the headbox, in a storage vat, in the refiners, or in the mixing pump.

The introduction of the particles of filler into the fibrous cellulose composition may be carried out by mixing, in particular continuous mixing, with the fibrous composition, before the headbox.

According to one embodiment, such mixing can be carried out in a paper pulp vat.

According to another embodiment, the particles of filler according to the invention are introduced into the fibrous composition after said composition has been deposited on a forming surface. A forming surface suitable for the invention may be a Fourdrinier table.

The particles of pigment may be introduced into the fibrous cellulose composition by means of application devices such as a second headbox, a slot device or a spraying device.

These application devices are placed at any position before the wet press section, i.e. in the wet part of the paper machine.

According to one embodiment, the particles of filler may be introduced into a fibrous cellulose composition arranged in the form of a blanket on the forming surface, by means of a secondary headbox or by means of a slot coater, and more particularly by means of a curtain coating head.

For the purposes of the invention, the expression "slot coater or slot orifice" is intended to denote coating heads in which the dispersion to be deposited passes through an orifice and forms a curtain which falls on the fibrous cellulose composition, or paper pulp, before the wet press section.

According to another embodiment, the particles of filler may be sprayed into a wet fibrous cellulose composition, at any place before the wet press section.

The particles of filler are preferably sprayed at a pressure and/or a rate sufficient to allow them to penetrate into the paper pulp.

According to one implementation variant, the particles of filler of the invention are introduced into the paper pulp by means of a combination of the various application devices above, before the wet press section.

A process for preparing a decorative paper of the invention may comprise a step consisting of addition of a wet strength agent and/or a retaining agent, as defined above.

Preferably, the wet strength agent is a polyamine-epichlorohydrin resin, and the retaining agent may be a system of inorganic microparticles, for example anionic silicas, or a polyacrylamide of low ionicity.

The fibrous cellulose composition, or paper pulp, incorporating particles of filler of the invention, and the optional additional agents, may then be subjected to any drying step usually carried out in the paper industry in order to obtain a sheet of decorative paper.

A process for preparing a paper according to the invention comprises a drying step which may be performed by any method known to those skilled in the art and usually carried out in the field. Such methods do not therefore need to be described further herein.

A process for preparing a decorative paper of the invention may also comprise an additional step of surface treatment of the paper.

Such a treatment may be a physical treatment, for example in order to improve the smoothness of the paper, or be a chemical treatment, for example a penetrating coating. A penetrating coating may, for example, consist in treating the surface of a paper with an agent intended to promote ink retention as previously described. This step may in particular be carried out using a size press or a film press.

According to one particular embodiment, a process according to the invention may comprise a step of surface treatment, in particular by penetrating coating.

A surface treatment may consist in carrying out a penetrating coating with any agent normally used in the field. In particular, the layer deposited may comprise at least one agent chosen from the group consisting of a cationic polymer and an absorbent organic polymer. The cationic and organic polymers may, in particular, be as previously defined.

According to one embodiment, a step of surface treatment, in particular by penetrating coating, may advantageously be carried out with at least one cationic polymer or at least one absorbent organic polymer, as previously described, and preferably with polydiallyldimethylammonium or a microcrystalline cellulose.

A paper of the invention may advantageously be used for preparing a high-pressure or low-pressure laminate or a continuous pressed laminate.

In the case of a high-pressure laminate, the basic constituents of the laminate are the kraft sheets impregnated with thermosetting resin and the decorative paper of the invention optionally impregnated with a thermosetting resin.

In the case of a low-pressure laminate, the basic constituents of the laminate are the support board, such as a board of agglomerated particles, and a decorative paper of the invention optionally impregnated with a thermosetting resin.

Figure 3A:
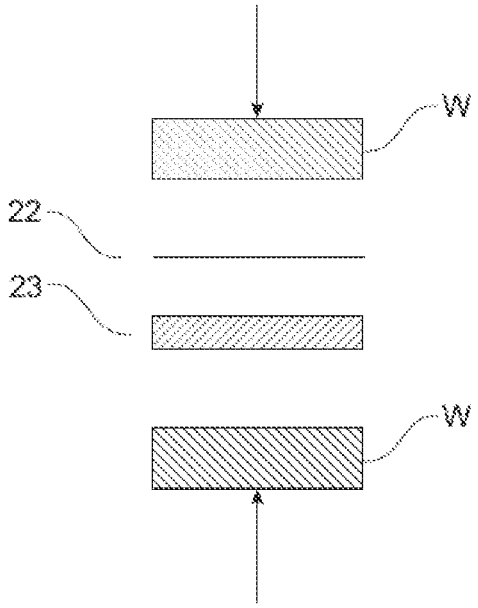
FIG. 3A is a schematic representation of a low-pressure laminate and a board of particles placed between platens of a press according to an embodiment.

FIG. 3A represents, in section, the constituents of a low-pressure laminate, placed between the platens W of a press, comprising a decorative paper 22 according to the invention, impregnated with a thermosetting resin, and optionally inkjet-printed with a pattern on at least one of its faces, and a board of particles 23.

Figure 3B:
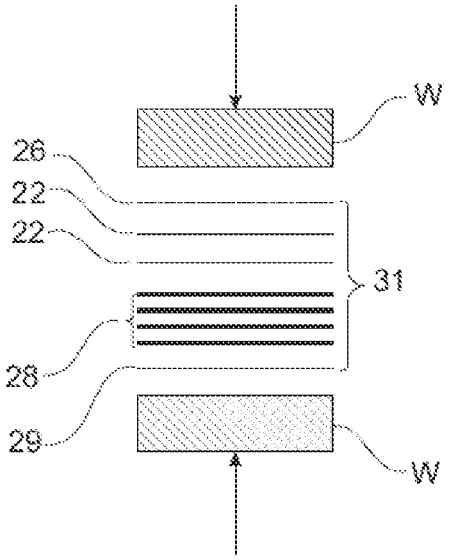
FIG. 3B is a schematic representation of a high-pressure laminate placed between platens of a press according to an embodiment.

FIG. 3B represents, in section, the constituents of a high-pressure laminate. The laminate comprises an overlay 26, and a stack of decorative papers 22 according to the invention, optionally comprising at least one pattern inkjet-printed on at least one of their faces. A stack of several decorative papers 22, each bearing at least one pattern printed on at least one of their faces, is advantageous in that it may make it possible to creates a 3D optical effect. The stack of decorative papers 22 is deposited on a stack 28 of sheets of kraft paper, itself deposited on a "counterbalancing" sheet. The various sheets are each impregnated with a thermosetting resin. According to one embodiment not shown, the overlay 26 and/or the sheet 29 are absent.

Figure 3C:
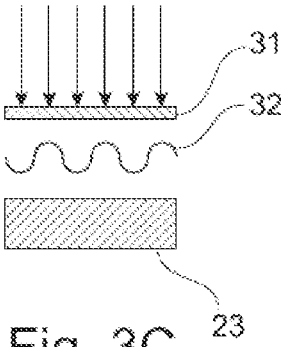
FIG. 3C is a schematic representation of a pasting of a laminate onto a support by means of an adhesive according to an embodiment.

FIG. 3C illustrates the pasting of a laminate 31 of the invention, for example as described in FIG. 3B, onto a support 23 by means of an adhesive 32.

The examples presented hereinafter are given by way of illustration of the invention and should not be interpreted in a limiting manner.

EXAMPLES

Example 1 a—Preparation of Decorative Papers

A mixture of cellulose fibers comprising 20% by weight of bleached kraft pulp-derived long fibers from conifers of spruce type, and 80% by weight of bleached kraft pulp-derived short fibers of *eucalyptus* is suspended in an aqueous phase.

The suspension is subjected to a refining step in order to obtain a Gurley porosity of 15 sec.

Added to this suspension, separately, are the various fillers according to the nature and the contents indicated (expressed as % of ash at 800° C.) below. The fillers are introduced in the form of an aqueous dispersion at 15% by weight. A wet strength agent of polyamide-epichlorohydrin type is then added at a content of 0.6% on a dry basis. To finish, a retaining agent of silica microparticle type is introduced, at the top of the machine, at a content of 0.5% on a dry basis.

The paper (C) is obtained according to the process described in patent EP 1 749 134, and corresponds to example 4 of said patent.

A very smooth, plain white decorative paper having a grammage of 80 g/m$^2$, a Gurley porosity of 20 s and a Bekk smoothness of 20 s, and containing 38% of ash, is manufactured by means of a usual papermaking process on a Fourdrinier paper machine. This support thus formed is a standard paper (A).

This paper is then coated by means of the curtain coating process, on one of its faces, with 10 g/m$^2$ by dry weight of a layer for inkjet printing composed of 28.6 parts of the binder made from a mixture of an aqueous solution of hydrophilic polyvinyl alcohol (PVA) and a poly(vinyl acetate) in stabilized aqueous dispersion (termed latex), respectively in proportions of 85/15 by dry weight, and of 100 parts of an (amorphous) coating silica having an average particle size of 5.3-6.3 μm and a (BET) specific surface area of 160 m$^2$/g. This coated paper is the paper (C).

TABLE 1

| Paper | Filler type (BET specific surface area & oil absorption) | % content by weight of dry paper |
|---|---|---|
| Standard (A) (outside the invention) | $TiO_2$ RCL 722 | 20 |
| 100% cellulose (B) (outside the invention) | No filler | 0 |
| 1 | Syloid ® (BET 400 m$^2$/g | 10 |
| 2 | and oil absorption 320%) | 15 |
| 3 | | 20 |
| 4 | | 25 |
| 6 | Syloid ® (BET 400 m$^2$/g and oil absorption 180%) | 20 |
| 7 | Syloid ® (BET 700 m$^2$/g and oil absorption 80%) | 20 |
| 8 | Celite ® (BET 10 m$^2$/g and oil absorption 130%) | 20 |
| 9 | Aluminosilicate (BET 100 m$^2$/g and oil absorption 80%) | 20 |
| 10 (outside the invention) | Aluminosilicate (BET 4 m$^2$/g and oil absorption 62%) | 20 |
| M-Jet (patent EP 1 749 134 - Example 4) (C) (outside the invention) | Coated paper | |

b—Printing

The papers prepared above were printed by means of an inkjet printing technique with aqueous inks on a Hewlett Packard (HP) Deskjet 6540 printer and with UV-crosslinkable inks using a Jupiter Digital printing tracer from the company Hymmen.

c—Measurement of the Color Density and Visual Analysis

The color density of the printed papers was measured using an X rite 500 densitometer in yellow, black, magenta and cyan.

The visual analysis of the printed papers was carried out using an observer panel which performed a classification from good to poor according to the fineness of the ink dots.

The results obtained are shown in detail in tables 2 and 3 hereinafter.

TABLE 2

| printing with an aqueous ink | | | | | |
|---|---|---|---|---|---|
| | Color density | | | | Visual analysis |
| Paper | Magenta | Yellow | Cyan | Black | definition |
| Standard (A) (outside the invention) | 0.74 | 0.67 | 1.02 | 1.16 | Poor |
| 100% cellulose (B) (outside the invention) | 1.42 | 0.99 | 1.24 | 1.9 | Medium |
| 1 | 1.37 | 0.89 | 1.28 | 1.87 | Good |
| 2 | 1.37 | 0.88 | 1.29 | 1.83 | Very good |
| 3 | 1.4 | 0.86 | 1.29 | 1.87 | Very good |
| 4 | 1.4 | 0.86 | 1.3 | 1.89 | Very good |
| 6 | 1.24 | 0.84 | 1.17 | 1.74 | Very good |
| 7 | 1.48 | 0.98 | 1.29 | 1.8 | Good |
| 8 | 1.46 | 0.97 | 1.34 | 1.77 | Good |
| 9 | 1.49 | 0.94 | 1.39 | 1.74 | Very good |
| 10 (outside the invention) | 1.42 | 0.92 | 1.26 | 1.57 | Medium |
| M-Jet (patent EP 1 749 134 - Example 4) (C) (outside the invention) | 1.38 | 0.88 | 1.27 | 1.88 | Excellent |

The results obtained show that the fillers specifically selected for the invention allow the preparation of a decorative paper, suitable for inkjet printing with an aqueous ink, without the need to use a print-fixing layer as in the prior art.

TABLE 3

| printing with a UV-crosslinkable ink | | | | | |
|---|---|---|---|---|---|
| | Color density | | | | Visual analysis |
| Paper | cyan | magenta | yellow | black | Definition |
| Standard (A) (outside the invention) | 0.71 | 0.55 | 0.44 | 0.58 | Poor |
| 100% cellulose (B) (outside the invention) | 1.44 | 1.12 | 0.73 | 1.12 | Very poor |
| 1 | 1.27 | 1.04 | 0.68 | 0.96 | Good |
| 2 | 1.18 | 0.96 | 0.62 | 0.88 | Very good |
| 3 | 1.11 | 0.94 | 0.6 | 0.82 | Very good |
| 4 | 1.09 | 0.9 | 0.57 | 0.8 | Very good |
| 6 | 1.09 | 0.86 | 0.58 | 0.88 | Good |
| 7 | 1.41 | 1.01 | 0.67 | 1.15 | Medium |
| 8 | 1.43 | 1.08 | 0.69 | 1.18 | Medium |
| 9 | 1.29 | 0.96 | 0.6 | 1.04 | Medium |
| 10 (outside the invention) | 1.33 | 1.01 | 0.65 | 1.1 | Poor |
| M-Jet (patent EP 1 749 134 - Example 4) (C) (outside the invention) | 0.95 | 0.87 | 0.57 | 0.76 | Very good |

The results obtained show that the fillers specifically selected for the invention allow the preparation of a decorative paper suitable for inkjet printing with a UV-crosslinkable ink, without the need to use an ink-fixing layer. The fillers which do not have these properties give a good printing strength, but a mediocre definition.

Example 2

In this example, the opacity before impregnation with a thermosetting resin is measured on the papers prepared in example 1, as is the time for impregnation of these papers with a thermosetting resin.

High-pressure laminates are prepared by means of these papers according to a usual process. The high-pressure laminates prepared comprise 10 sheets of kraft paper and 10 sheets of decorative papers.

The results of the various measurements carried out are summarized in table 4 hereinafter.

TABLE 4

| | Penetration time (sec) according to measuring method defined above | | % opacity | |
|---|---|---|---|---|
| Paper | Decor side | Back side | Paper | Laminate |
| Standard (A) (outside the invention) | 2 | 3 | 97.6 | 93.5 |
| 100% cellulose (B) (outside the invention) | 1 | 1 | 64.2 | 10.5 |
| 2 | 4 | 4 | 81.7 | 11.7 |
| M-Jet (patent EP 1 749 134 - Example 4) (C) (outside the invention) | 32 | 7 | 99.2 | 95.6 |

The invention claimed is:

1. A decorative paper for a high-pressure, low-pressure or continuous-pressed decorative laminate, comprising: distributed through a thickness of said paper, particles of a filler having an oil absorption of greater than or equal to 80%, and having a median diameter D50 ranging from 0.5 to 10 μm, and having a specific surface area greater than or equal to 20 $m^2/g$.

2. The decorative paper as claimed in claim 1, the particles of filler having an oil absorption greater than or equal to 100%.

3. A decorative paper for a high-pressure, low-pressure or continuous-pressed decorative laminate, comprising: distributed through a thickness of said paper, particles of a filler having an oil absorption of greater than or equal to 80%, having a median diameter D50 ranging from 0.5 to 10 μm, and having a refractive index n of less than 1.9.

4. The decorative paper as claimed in claim 1, the particles of filler having a median diameter D50 ranging from 2 to 8 μm.

5. The decorative paper as claimed in claim 1, the particles of filler having a shape chosen from a lamellar shape, a globular shape and a spherical shape.

6. The decorative paper as claimed in claim 1, the particles of filler having a refractive index n of less than 1.9.

7. The decorative paper as claimed in claim 1, the particles of filler being chosen from inorganic particles, organic particles, and mixtures thereof.

8. The decorative paper as claimed in claim 7, the particles of filler being inorganic and having a specific surface area greater than or equal to 50 $m^2/g$ and an oil absorption greater than or equal to 80%.

9. The decorative paper as claimed in claim 7, the particles being inorganic and chosen from particles of amorphous silicas, particles of precipitated silicas, particles of diatomaceous earths, particles of aluminosilicates, and mixtures thereof.

10. The decorative paper as claimed in claim 1, the particles of filler being present in an amount ranging from 3% to 40% by weight relative to the total dry weight of the paper.

11. The decorative paper as claimed in claim 1, said paper exhibiting a speed of impregnation with a thermosetting resin of less than or equal to 20 seconds.

12. The decorative paper as claimed in claim 1, said paper exhibiting, on at least one of its faces, a Bekk smoothness of 20 to 140 seconds.

13. The paper as claimed in claim 1, said paper being devoid of particles other than the particles of fillers.

14. The decorative paper as claimed in claim 1, said paper being devoid of an ink-fixing surface layer.

15. The decorative paper as claimed in claim 1, said paper being transparent after impregnation with a thermosetting resin.

16. The decorative paper as claimed in claim 1, also comprising at least one pattern printed on at least one of its faces.

17. A process for preparing a decorative paper as defined in claim 1, comprising:

preparing a wet fibrous cellulose composition, and introducing into said fibrous composition, in the wet part of a paper machine, particles of a filler as defined in claim 1.

18. The process as claimed in claim 17, said particles being introduced into said fibrous composition by mixing with said composition before a headbox.

19. The process as claimed in claim 17, said particles being introduced into said fibrous composition by mixing in a paper pulp vat.

20. The process as claimed in claim 17, said particles being introduced into said fibrous composition after said composition has been deposited on a forming surface.

21. The process as claimed in claim 20, said particles being introduced into said fibrous composition by means of a second headbox, by means of a slot device, or by means of a spraying device.

22. The process as claimed in claim 17, said particles being introduced into said fibrous composition in the form of a dispersion, preferably an aqueous dispersion, or in the form of a powder.

23. The process as claimed in claim 22, the aqueous dispersion of particles consisting substantially of a mixture of water and said particles.

24. The process as claimed in claim 17, further comprising adding to said fibrous composition a wet strength agent and/or a retaining agent.

25. The process as claimed in claim 17, comprising a step of surface treatment, in particular by penetrating coating, advantageously with polydiallyldimethylammonium or a microcrystalline cellulose.

26. A high-pressure, low-pressure or continuous-pressed laminate, comprising at least one decorative paper as defined in claim 1, or capable of being obtained according to a process as defined in claim 17.

27. The laminate as claimed in claim 26, comprising a superposition of at least two, of at least three, or of at least four, decorative papers as defined in claim 1, or capable of being obtained according to the process as defined in claim 17.

28. The use of particles of a filler as defined in claim 1, in a decorative paper for a high-pressure, low-pressure or continuous-pressed laminate, for improving the printability by inkjet printing of said decorative paper.

29. The decorative paper as claimed in claim 10, the particles of filler being present in an amount ranging from 5% to 35% by weight relative to the total dry weight of the paper.

30. A decorative paper for a high-pressure, low-pressure or continuous-pressed decorative laminate, comprising: distributed through a thickness of said paper, particles of a filler having an oil absorption of greater than or equal to 80%, and having a median diameter D50 ranging from 0.5 to 10 μm, said paper exhibiting a speed of impregnation with a thermosetting resin of less than or equal to 20 seconds.

31. A decorative paper for a high-pressure, low-pressure or continuous-pressed decorative laminate, comprising: distributed through a thickness of said paper, particles of a filler having an oil absorption of greater than or equal to 80%, and having a median diameter D50 ranging from 0.5 to 10 μm, said paper being transparent after impregnation with a thermosetting resin.

32. A decorative paper for a high-pressure, low-pressure or continuous-pressed decorative laminate, comprising: distributed through a thickness of said paper, particles of a filler having an oil absorption of greater than or equal to 80%, and having a median diameter D50 ranging from 0.5 to 10 μm, said paper exhibiting, on at least one of its faces, a Bekk smoothness of 20 to 140 seconds.

* * * * *